US009556668B2

(12) United States Patent
Kadavy et al.

(10) Patent No.: US 9,556,668 B2
(45) Date of Patent: Jan. 31, 2017

(54) WEATHER SEAL SYSTEM FOR DOUBLE HUNG WINDOWS

(71) Applicant: Pella Corporation, Pella, IA (US)

(72) Inventors: Dale Robert Kadavy, Overland Park, KS (US); Jonathan S. Hoogland, Pella, IA (US); Andy Breuer, Newton, IA (US); Todd A. Bernhagen, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/746,422

(22) Filed: Jun. 22, 2015

(65) Prior Publication Data

US 2015/0284988 A1 Oct. 8, 2015

Related U.S. Application Data

(62) Division of application No. 13/963,799, filed on Aug. 9, 2013, now Pat. No. 9,062,490.

(60) Provisional application No. 61/682,098, filed on Aug. 10, 2012.

(51) Int. Cl.

| | |
|---|---|
| ***E06B 7/22*** | (2006.01) |
| ***E06B 1/36*** | (2006.01) |
| ***E06B 3/44*** | (2006.01) |
| ***E06B 7/23*** | (2006.01) |
| ***E06B 7/16*** | (2006.01) |
| ***E06B 7/14*** | (2006.01) |
| ***E06B 1/70*** | (2006.01) |

(52) U.S. Cl.

CPC . *E06B 7/22* (2013.01); *E06B 1/36* (2013.01); *E06B 3/4415* (2013.01); *E06B 7/14* (2013.01); *E06B 7/16* (2013.01); *E06B 7/2305* (2013.01); *E06B 1/702* (2013.01)

(58) Field of Classification Search

CPC ..... E06B 7/16; E06B 7/2305; E06B 7/14; E06B 7/702; E06B 1/702

USPC ..... 52/209, 204.52, 204.591, 204.593,52/204.595

See application file for complete search history.

(56) References Cited

U.S. PATENT DOCUMENTS

| | | | |
|---|---|---|---|
| 1,922,860 | A | 8/1933 | Powell |
| 3,274,735 | A | 9/1966 | Stackhouse |
| 3,503,169 | A | 3/1970 | Johnson et al. |
| 3,851,420 | A | 12/1974 | Tibbetts |
| 4,055,917 | A | 11/1977 | Coller |
| 4,068,433 | A | 1/1978 | Glover |
| 4,087,942 | A | 5/1978 | Hermann |
| 4,154,033 | A | 5/1979 | Krueger et al. |

(Continued)

FOREIGN PATENT DOCUMENTS

FR 2224632 A1 10/1974

OTHER PUBLICATIONS

Andersen® Frenchwood® Hinged Patio Doors, 400 Series, Architectural Detail File, marked Rev. Mar. 2005, 21 pages.

(Continued)

*Primary Examiner* — Rodney Mintz

(74) *Attorney, Agent, or Firm* — Faegre Baker Daniels LLP

(57) ABSTRACT

A window includes a weather seal system that employs two seals. The first seal is located towards an exterior surface of the window and forms an air-permeable water barrier between an active sash and a sill. The second seal is located towards an interior surface of the window and forms a substantially air-impermeable and water-impermeable barrier between the active sash and the sill.

18 Claims, 9 Drawing Sheets

(56) References Cited

U.S. PATENT DOCUMENTS

| | | | | |
|---|---|---|---|---|
| 4,185,416 | A | 1/1980 | Wilmes | |
| 4,214,405 | A | 7/1980 | Chupik | |
| 4,237,664 | A | 12/1980 | Wilmes | |
| 4,292,771 | A | 10/1981 | Ellis | |
| 4,310,991 | A | 1/1982 | Seely | |
| 4,447,987 | A | 5/1984 | Lesosky | |
| 4,502,249 | A | 3/1985 | Banford | |
| 4,660,338 | A | 4/1987 | Wagner | |
| 4,831,779 | A | 5/1989 | Kehrli et al. | |
| 4,831,804 | A * | 5/1989 | Sayer | E06B 3/222 52/204.593 |
| 4,837,977 | A | 6/1989 | Mauro | |
| 4,891,921 | A | 1/1990 | Governale | |
| 4,974,364 | A | 12/1990 | Durham | |
| 4,974,366 | A | 12/1990 | Tizzoni | |
| 5,018,307 | A | 5/1991 | Burrous et al. | |
| 5,026,581 | A | 6/1991 | Shea, Jr. et al. | |
| 5,044,121 | A * | 9/1991 | Harbom | E06B 3/325 49/401 |
| 5,051,560 | A | 9/1991 | Fremaux et al. | |
| 5,067,279 | A | 11/1991 | Hagemeyer | |
| 5,081,793 | A | 1/1992 | Mauro | |
| 5,123,212 | A * | 6/1992 | Dallaire | E06B 7/14 49/408 |
| 5,174,065 | A | 12/1992 | Schlicht | |
| 5,179,804 | A | 1/1993 | Young | |
| 5,341,600 | A | 8/1994 | Heppner | |
| 5,355,625 | A | 10/1994 | Matsuoka | |
| 5,371,987 | A | 12/1994 | Hirsch et al. | |
| 5,675,947 | A | 10/1997 | Yane | |
| 5,682,715 | A | 11/1997 | McKann et al. | |
| 5,687,508 | A | 11/1997 | Fitzhenry et al. | |
| 5,822,923 | A | 10/1998 | Governale | |
| 5,832,681 | A | 11/1998 | Johnson | |
| 5,870,859 | A | 2/1999 | Kitada | |
| 5,887,387 | A | 3/1999 | Dallaire | |
| 6,219,971 | B1 | 4/2001 | Headrick | |
| 6,293,049 | B1 | 9/2001 | Shaw | |
| 6,334,283 | B1 | 1/2002 | Edger | |
| 6,367,201 | B1 | 4/2002 | Massey et al. | |
| 6,374,545 | B1 | 4/2002 | Baczuk | |
| 6,374,557 | B1 * | 4/2002 | O'Donnell | E06B 7/14 160/44 |
| 6,430,889 | B1 | 8/2002 | Nixon et al. | |
| 6,523,311 | B2 | 2/2003 | Edger | |
| 6,665,989 | B2 | 12/2003 | Bennett | |
| 6,722,089 | B2 | 4/2004 | Budzinski | |
| 6,883,279 | B2 | 4/2005 | Fukuro et al. | |
| 7,000,959 | B2 | 2/2006 | Sanders | |
| 7,010,894 | B1 | 3/2006 | Cappelle | |
| 7,263,808 | B2 | 9/2007 | Massey et al. | |
| 7,266,929 | B1 | 9/2007 | Allred et al. | |
| 7,481,028 | B2 | 1/2009 | Tuffs et al. | |
| D588,905 | S | 3/2009 | Meeks et al. | |
| 7,552,562 | B2 | 6/2009 | Curtis et al. | |
| 7,596,912 | B2 | 10/2009 | Ito et al. | |
| 7,905,058 | B2 | 3/2011 | Massey et al. | |
| 8,001,736 | B2 | 8/2011 | Goldberg et al. | |
| 8,074,409 | B2 | 12/2011 | Goldberg et al. | |
| 8,074,410 | B1 | 12/2011 | Ryba | |
| 8,127,500 | B2 | 3/2012 | Meeks et al. | |
| 8,132,370 | B2 | 3/2012 | Heppner | |
| 8,276,320 | B2 | 10/2012 | Erbrect et al. | |
| 8,353,138 | B2 * | 1/2013 | Sigmund | E06B 7/14 52/204.5 |
| 8,393,115 | B2 | 3/2013 | Schroder et al. | |
| 8,713,854 | B2 | 5/2014 | Schroder et al. | |
| 8,733,025 | B2 | 5/2014 | Baumert | |
| 9,062,490 | B2 | 6/2015 | Kadavy et al. | |
| 9,097,059 | B1 * | 8/2015 | Flynn | E06B 7/26 |
| 2003/0041537 | A1 * | 3/2003 | Glover | E06B 1/00 52/204.5 |
| 2006/0150521 | A1 | 7/2006 | Henry et al. | |
| 2007/0218270 | A1 | 9/2007 | Huntress et al. | |
| 2007/0227076 | A1 | 10/2007 | Braun | |
| 2008/0120914 | A1 | 5/2008 | Fink et al. | |
| 2008/0216424 | A1 | 9/2008 | Westphal et al. | |
| 2009/0038231 | A1 | 2/2009 | Erbrect et al. | |
| 2010/0162644 | A1 | 7/2010 | Campbell et al. | |
| 2010/0192488 | A1 | 8/2010 | Campbell et al. | |
| 2011/0047884 | A1 | 3/2011 | Schroder | |
| 2011/0239562 | A1 * | 10/2011 | Ryan | E06B 7/14 52/209 |
| 2011/0258947 | A1 | 10/2011 | Peterson | |
| 2012/0005975 | A1 | 1/2012 | Kim | |
| 2013/0247474 | A1 | 9/2013 | Schroder et al. | |
| 2013/0312343 | A1 * | 11/2013 | Markham | E06B 3/5454 52/204.69 |
| 2014/0041326 | A1 | 2/2014 | Kadavy et al. | |
| 2015/0233171 | A1 | 8/2015 | Ritzert et al. | |

OTHER PUBLICATIONS

Chapter 12, Clad Ultimate Inswing French Door, Marvin Architectural Detail Manual No. 11708608, marked with various dates such as Mar. 23, 2009, 42 pages.

Installation Guide for Andersen® 400 Series Frenchwood® Hinged Patio Doors or 400 Series Frenchwood® Hinged Patio Doors with Stormwatch® Protection, Instruction Guide 0004234 BB, © 1997-2008, marked Revised Apr. 29, 2008, 12 pages.

Installation Instruction—Premium Wood Entry Door, Part No. E829300, © 2008 Pella Corporation, 6 pages.

NAFS—North American Fenestration Standard/Specification for Windows, Doors, and Skylights, AAMA/WDMA/CSA 101/I.S.2/A440-08, Copyright 2008, downloaded from http://www.aamanet.org/upload/file/CMB-5-08.pdf.

Ramped Sill Insert for Andersen® Patio Doors, Instruction Guide 0004392, © 1996-2004, marked Revised Apr. 13, 2004, 6 pages.

Tru-Defense® Door System, © 2009 Therma-Tru, downloaded from http://www.thermatru.com, 1 page.

* cited by examiner

WEATHER SEAL SYSTEM FOR DOUBLE HUNG WINDOWS

RELATED APPLICATIONS

This application is a divisional of U.S. application Ser. No. 13/963,799, filed Aug. 9, 2013, and entitled "Weather Seal System for Double Hung Windows," now U.S. Pat. No. 9,062,490, which claims priority to U.S. Provisional Patent Application No. 61/682,098, filed Aug. 10, 2012, and entitled "Weather Seal System for Double Hung Windows," which are incorporated herein in their entirety for all purposes.

TECHNICAL FIELD

Embodiments of the present invention relate generally to window seal systems and, in particular, to window seal systems for reducing moisture entry in double hung windows or the like.

BACKGROUND

Buildings and other structures are often constructed with rough openings in which a window is installed. The window may include seals to prevent moisture entry into the building, for example, during a rainstorm. Pressure differentials between the exterior of the building and the interior of the building can have a negative effect on the effectiveness of a seal by pushing water through the seal.

SUMMARY

Various embodiments of the present invention relate to a weather seal system that includes two seals; a primary seal configured to form a substantially air-tight and substantially water-proof barrier between a sash and a sill and a secondary seal configured to form an air-permeable water barrier between the sash and the sill. The secondary seal allows a chamber within the sill to have the same air pressure as the window exterior to reduce the effects of pressure differentials on the weather seal system.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
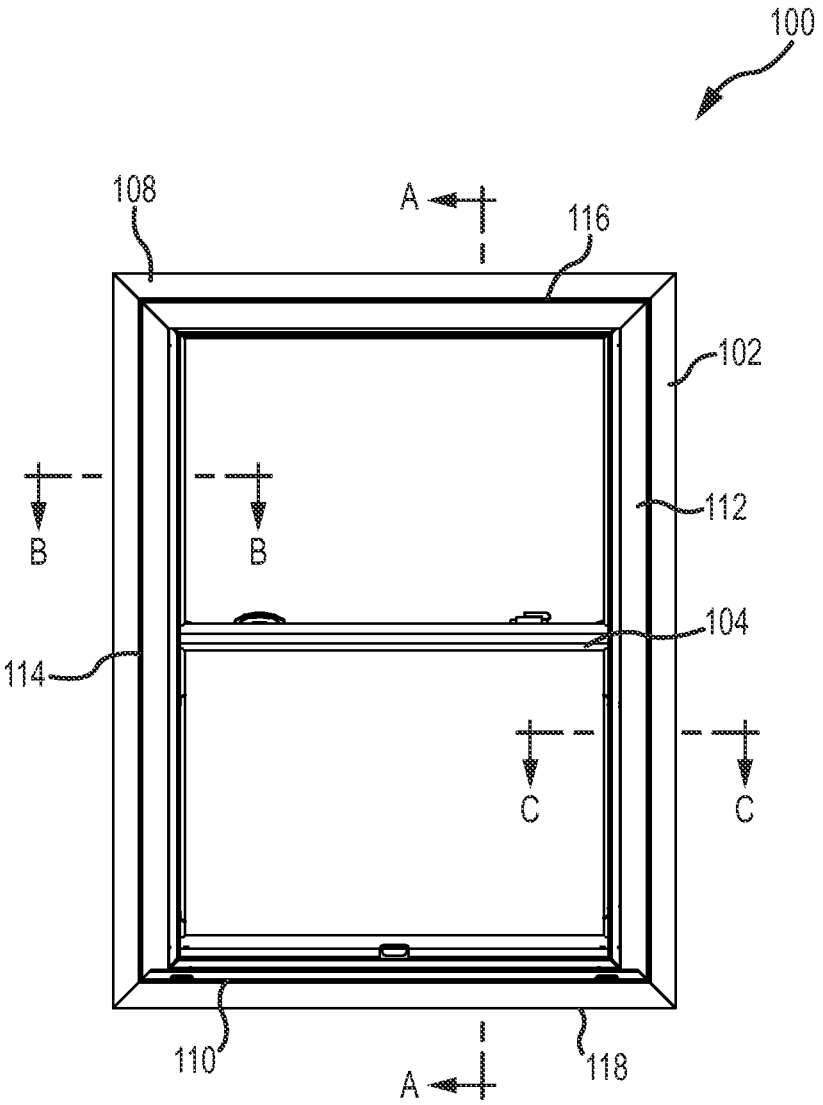
FIG. 1 is a front view of an exterior side of a one-wide window in accordance with embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention are directed to window systems that are installed as part of a closure assembly in a rough opening. As used herein, "closure" and "closure assembly" refer to double-hung, casement, awning and fixed windows, skylights, sliding and hinged doors, and the like. As used herein, "rough opening" refers to an opening in a wall or structure that has a perimeter, sized and shaped to receive a closure assembly, and a plurality of inner surfaces. The rough opening extends from an interior side of the structure to an exterior side. The exterior side of the structure is typically exposed to rain, wind, snow, ice and the like, while the interior side is typically protected from the elements.

As shown in FIG. 1, a window 100 includes a frame 102 and an active sash 104 moveable within the frame 102. The window 100 has an interior side 106 (as shown in, e.g., FIG. 4) that faces towards an interior of a structure (not shown) when the window 100 is installed in the structure. The window 100 also has an exterior side 108 that faces towards an exterior of a structure when the window 100 is installed in the structure. As discussed below in more detail, in some embodiments the window 100 includes multiple seals that reduce moisture entry into the structure and/or frame chambers to channel moisture away from the window.

Still referring to FIG. 1, the frame 102 includes a sill 110, jambs 112, 114, and a header 116. The sill 110 has a bottom sill surface 118 that is placed on or adjacent to a bottom frame member of a rough opening in a structure when the window is installed in the structure. FIG. 4A is a partial cut-away view of the window of FIGS. 1, 2, and 3 cut along the line A-A in FIGS. 1, 2, and 3. FIG. 4B is the same view as FIG. 4A with schematic water paths and operating pressures indicated. As shown in FIG. 4A, the sill 110 defines a sill height 112 as measured from the bottom sill surface 118 to a top sill surface 120. In some embodiments, the sill height 112 is approximately 1.5 inches or less, for example 0.25-1.75 inches. The sill 110 also includes a sill transition channel or sill chamber 122 at least partially defined by a front sill chamber surface 124, a bottom sill chamber surface 126, and a back sill chamber surface 128. In some embodiments, the front sill chamber surface 124 includes apertures or other mechanisms for conveying or transmitting moisture out of the sill chamber 122. The apertures or other mechanisms may include, or be in fluid communication with, one or more drain cavities 130 that extend through the sill 110 to the exterior side 108. The flow paths of moisture, or water W, are indicated by arrows in FIG. 4B as are the external pressure $P_{ext}$ and internal pressure $P_{int}$ areas.

In some embodiments, the bottom sill chamber surface 126 may be sloped, either in whole or in part, to facilitate gravitational transport of moisture to the front sill chamber surface 124, where the bottoms of the drain cavities 130 are located below the bottom sill chamber surface 126. In some embodiments, the front sill chamber surface 124 vertically extends from the bottom sill chamber surface 126 for a greater distance than the back sill chamber surface 128 vertically extends from the bottom sill chamber surface 126. For example, the front sill chamber surface 124 may vertically extend 1.3 inches as measured from the bottom chamber surface 126 while the back sill chamber surface 128 may vertically extend 0.75 inches as measured from the bottom sill chamber surface 126.

In some embodiments, the window 100 includes an interior sill seal 138, a primary sill seal 140 and a secondary sill seal 142. The interior sill seal 138 may be formed from air permeable and water resistant materials such as mohair and the like, the primary sill seal 140 may be formed from air and water resistant materials such as foam urethane and the like, and the secondary sill seal 142 may be formed from air permeable and water resistant materials such as mohair and the like. When the sash 104 is in a closed position, the primary sill seal 140 forms a substantially air-tight and substantially water impermeable seal between the sash 104 and the back sill chamber surface 128, and the secondary sill seal 142 forms an air-permeable seal with the front sill chamber surface 124 that functions as a water barrier. In this manner, secondary sill seal 142 helps the sill chamber 122 to maintain an air pressure that corresponds to an air pressure external to the structure and helps prevent pressure differentials from driving moisture through the secondary sill seal 142. Moisture that penetrates the secondary sill seal 142 is channeled out of the sill chamber 142, and away from the primary sill seal 140, through apertures or other mechanisms (e.g., one-way weep seals) in the front sill chamber surface 124 and/or through a drain cavity 130 as indicated in FIG. 4B.

Because the primary sill seal 140 forms a substantially air-tight and substantially water impermeable seal between the sash 104 and the back sill chamber surface 128, an interior sill chamber (e.g., interior sill chamber 146) is better able to maintain an air pressure that corresponds to an air pressure internal to the structure. In addition, as shown in FIG. 4, a height of the back sill chamber surface 128 and/or a length of the bottom sill chamber surface 126 helps to isolate the primary sill seal 140 from moisture penetrating the secondary sill seal 142 to help prevent pressure differentials between the sill chamber 122 and the interior sill chamber 146 from driving moisture through the primary sill seal 140. Thus, the seal system and drain paths according to various embodiments provide a window with a reduced sill height (e.g., a sill height of about 1.75 inches or less) while still meeting or exceeding industry standards, such as PG 100 under AAMA/WDMA/CSA 101/I.S.2/A440-08, "NAFS-North American Fenestration Standard/Specification for Windows, Doors, and Skylights."

In some embodiments, and as shown in FIGS. 1 and 4, the sash 104 is an active sash that is moveably coupled to the frame 102 between a closed position in which the primary sill seal 140 and secondary sill seal 142 contact the sill 110 and an open position in which the primary sill seal 140 and secondary sill seal 142 do not contact the sill 110. In some embodiments, the window 100 may include multiple sashes both active and inactive, as well as one or more screens (e.g., screen 188 in FIGS. 4-8) coupled to the sill 110.

Figure 5:
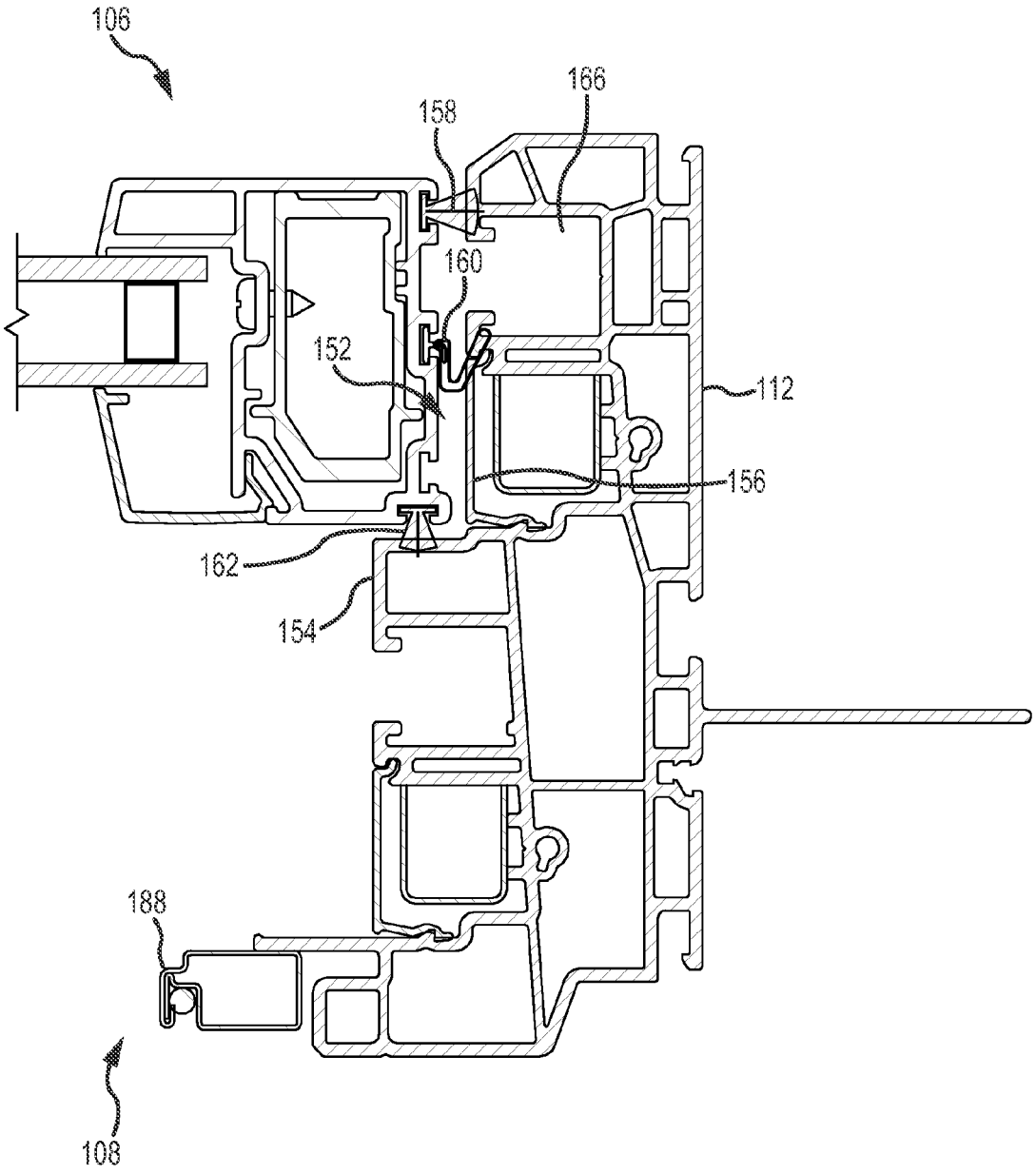
FIG. 5 is a cut-away view of the window of FIGS. 1, 2, and 3 cut along the line C-C in FIGS. 1, 2, and 3.

According to some embodiments, one or both of the jambs include a jamb transition channel or jamb chamber. For example, as shown in FIG. 5, the jamb 112 includes a jamb transition channel or jamb chamber 152 defined by a front jamb chamber surface 154 and a side jamb chamber surface 156. In some embodiments, the jamb chamber 152 is in fluid communication with the sill chamber 122 to convey moisture within the jamb chamber 152 through the sill chamber 122 and/or the drain cavity 130 to the exterior side 108 of the window 100.

As also shown in FIG. 5, the window 100 includes an interior seal 158, a primary jamb seal 160 and a secondary jamb seal 162. The interior seal 158 forms an air permeable and water resistant barrier. The primary jamb seal 160 forms a substantially air-tight and substantially water impermeable seal between the sash 104 and the side jamb chamber surface 156 and the secondary jamb seal 162 forms an air-permeable seal with the a front jamb chamber surface 154 that functions as a water barrier. In this manner, secondary jamb seal 162 helps the jamb chamber 152 to maintain an air pressure that corresponds to an air pressure external to the structure to prevent pressure differentials from driving moisture through the secondary jamb seal 162. Moisture that penetrates the secondary jamb seal 162 is channeled down to the sill channel 122 and/or the drain cavity 130.

Because the primary jamb seal 160 forms a substantially air-tight and substantially water impermeable seal between the sash 104 and the side jamb chamber surface 156, an interior jamb chamber (e.g., interior jamb chamber 166) is better able to maintain an air pressure that corresponds to an air pressure internal to the structure. In addition, the vertically-extending jamb chamber 152 channels moisture away from the primary jamb seal 160 to help prevent pressure differentials between the jamb chamber 152 and the interior jamb chamber 166 from driving moisture through the primary jamb seal 160.

Figure 6:
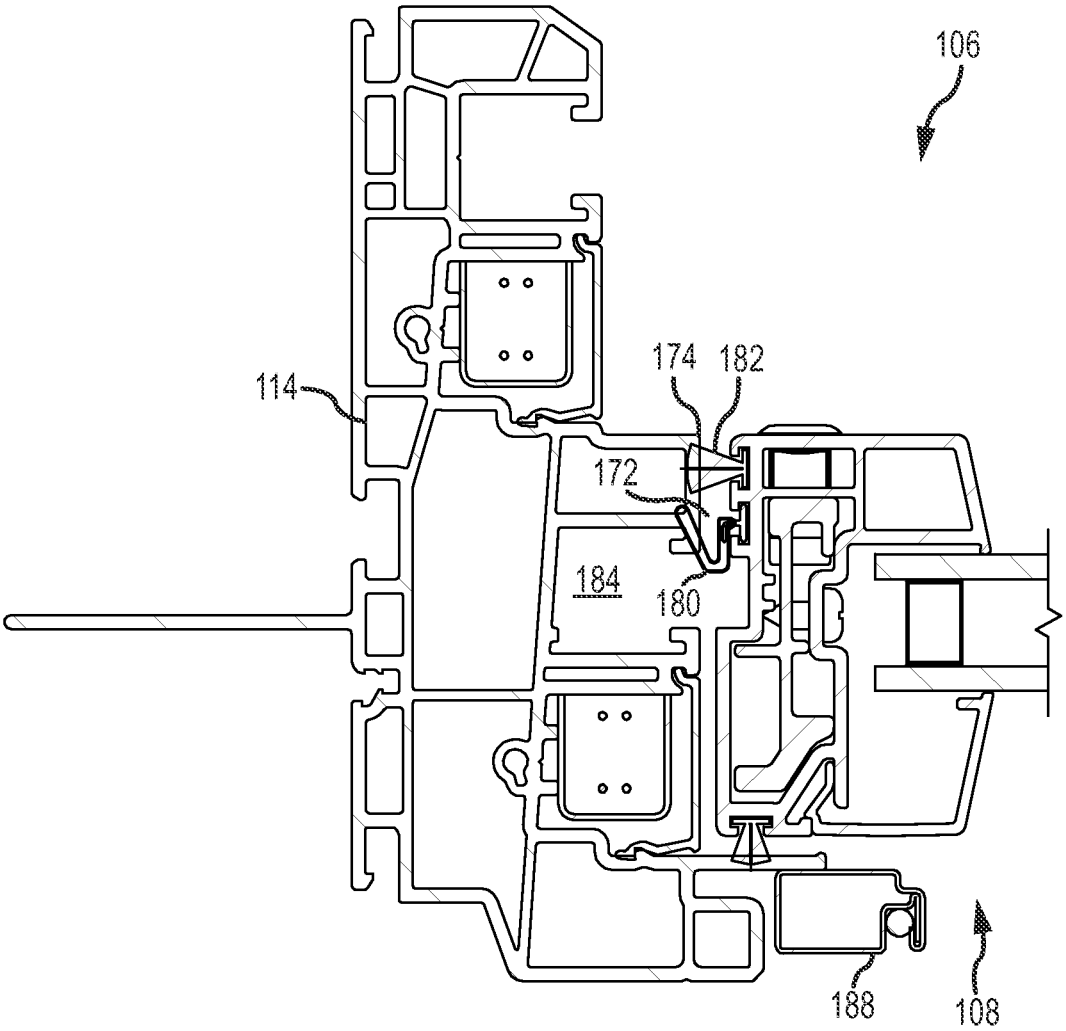
FIG. 6 is a cut-away view of the window of FIGS. 1, 2, and 3 cut along the line B-B in FIGS. 1, 2, and 3.
Figure 7:
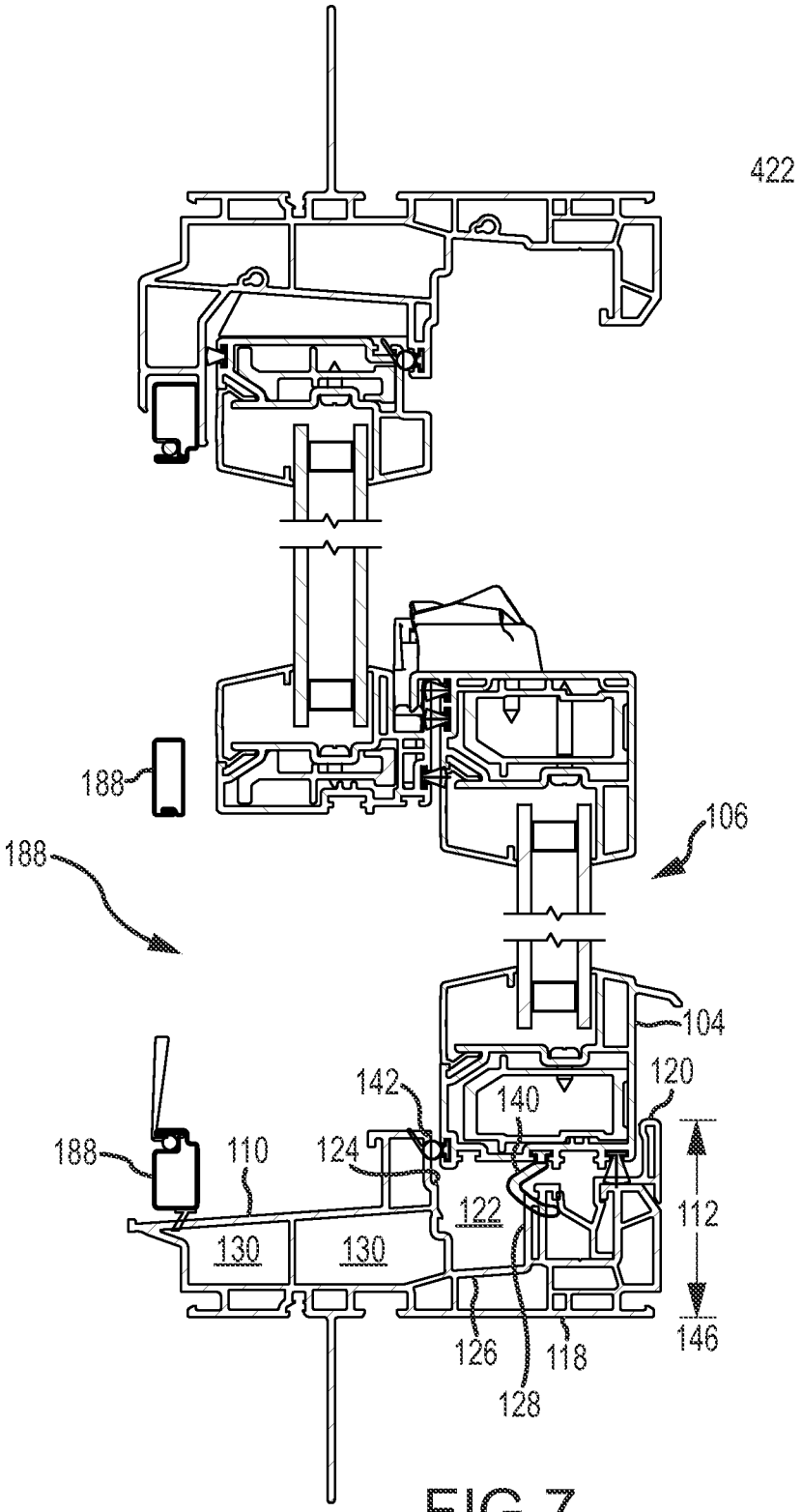
FIG. 7 is a full cut-away view of the window of FIGS. 1, 2, and 3 cut along the line A-A in FIGS. 1, 2, and 3.

As shown in FIG. 6, the jamb 114 also includes a jamb transition channel or jamb chamber 172 defined by a side jamb chamber surface 174. In some embodiments, the jamb chamber 172 is in fluid communication with the sill chamber 122 to convey moisture within the jamb chamber 172 through the sill chamber 122 and/or the drain cavity 130 to the exterior side 108 of the window 100.

As also shown in FIG. 6, the window 100 includes a primary jamb seal 180 and a secondary jamb seal 182. The primary jamb seal 180 forms a substantially air-tight and substantially water impermeable seal between the sash 104 and the side jamb chamber surface 174 and the secondary jamb seal 182 forms an air-permeable seal with the side jamb chamber surface 174 that functions as a water barrier. In this manner, secondary jamb seal 182 helps the jamb chamber 172 to maintain an air pressure that corresponds to an air pressure external to the structure to prevent pressure differentials from driving moisture through the secondary jamb seal 182. Any moisture that penetrates the secondary jamb seal 182 is channeled down to the sill channel 122 and/or the drain cavity 130.

Because the primary jamb seal 180 forms a substantially air-tight and substantially water impermeable seal between the sash 104 and the side jamb chamber surface 174, an interior jamb chamber (e.g., interior jamb chamber 184) is able to maintain an air pressure that corresponds to an air pressure internal to the structure. In addition, the vertically-extending jamb chamber 172 channels moisture away from the primary jamb seal 180 to prevent pressure differentials between the jamb chamber 172 and the interior jamb chamber 186 from driving moisture through the primary jamb seal 180.

In some embodiments, the primary jamb seals 160, 180, and the primary sill seal 140 may be unitarily formed of a single piece of material, or may be integrally formed of different materials or different portions of the same material. The secondary jamb seals 162, 182, and the secondary sill seal 142 may be unitarily formed of a single piece of material, or may be integrally formed of different materials or different portions of the same material.

Figure 2:
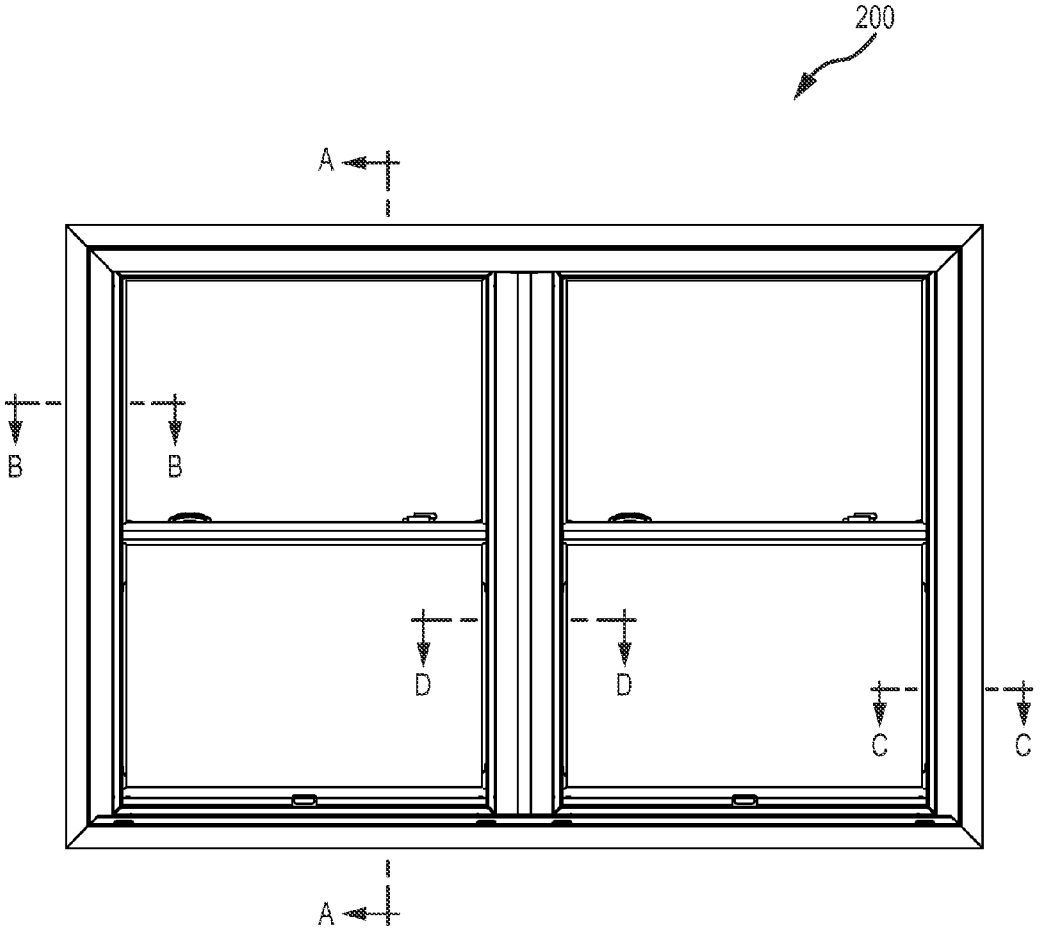
FIG. 2 a front view of an exterior side of a two-wide window in accordance with embodiments of the present invention.
Figure 3:
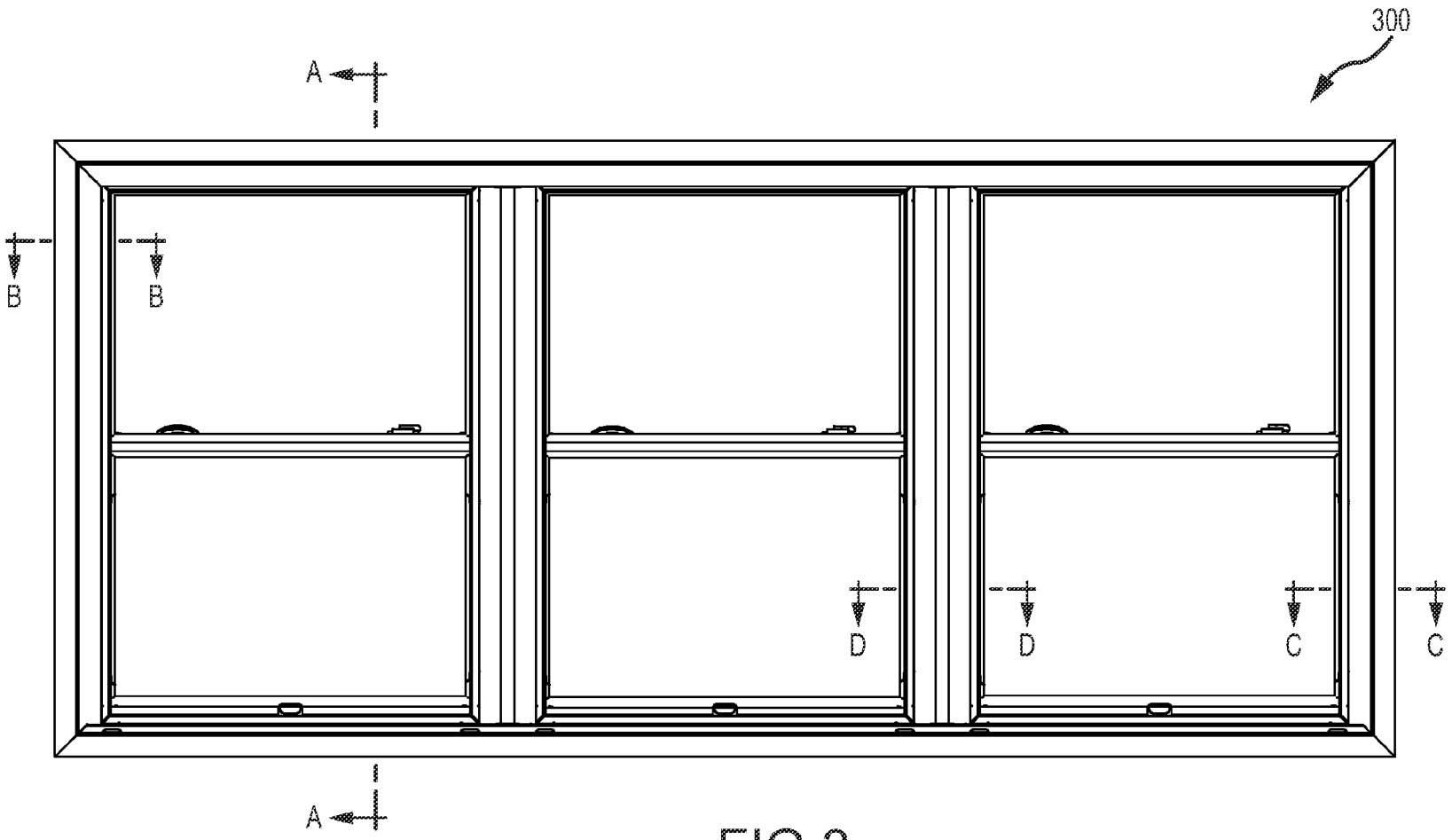
FIG. 3 is a front view of an exterior side of a three-wide window in accordance with embodiments of the present invention.
Figure 4A:
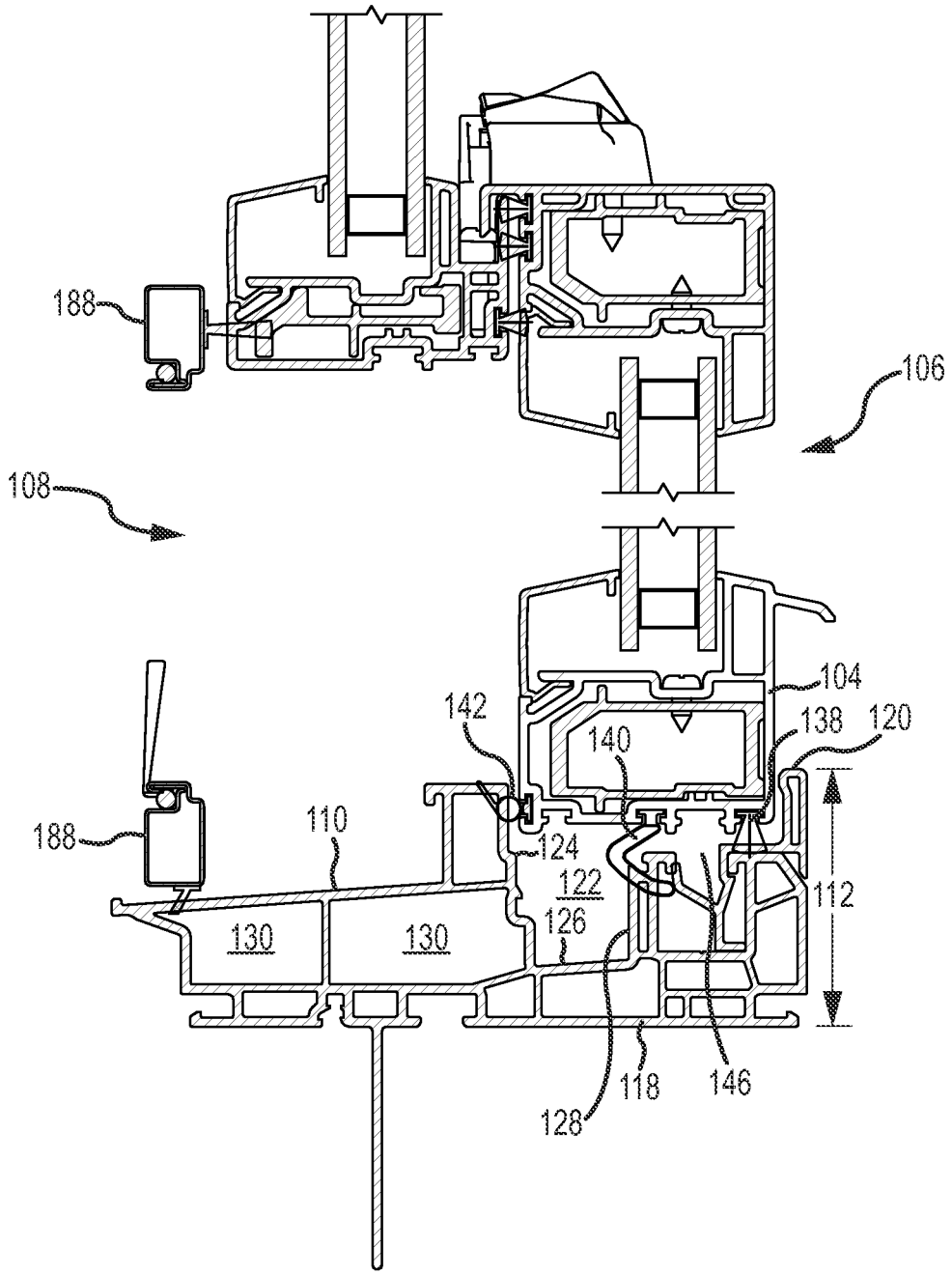
FIG. 4A is a partial cut-away view of the window of FIGS. 1, 2, and 3 cut along the line A-A in FIGS. 1, 2, and 3.
Figure 4B:
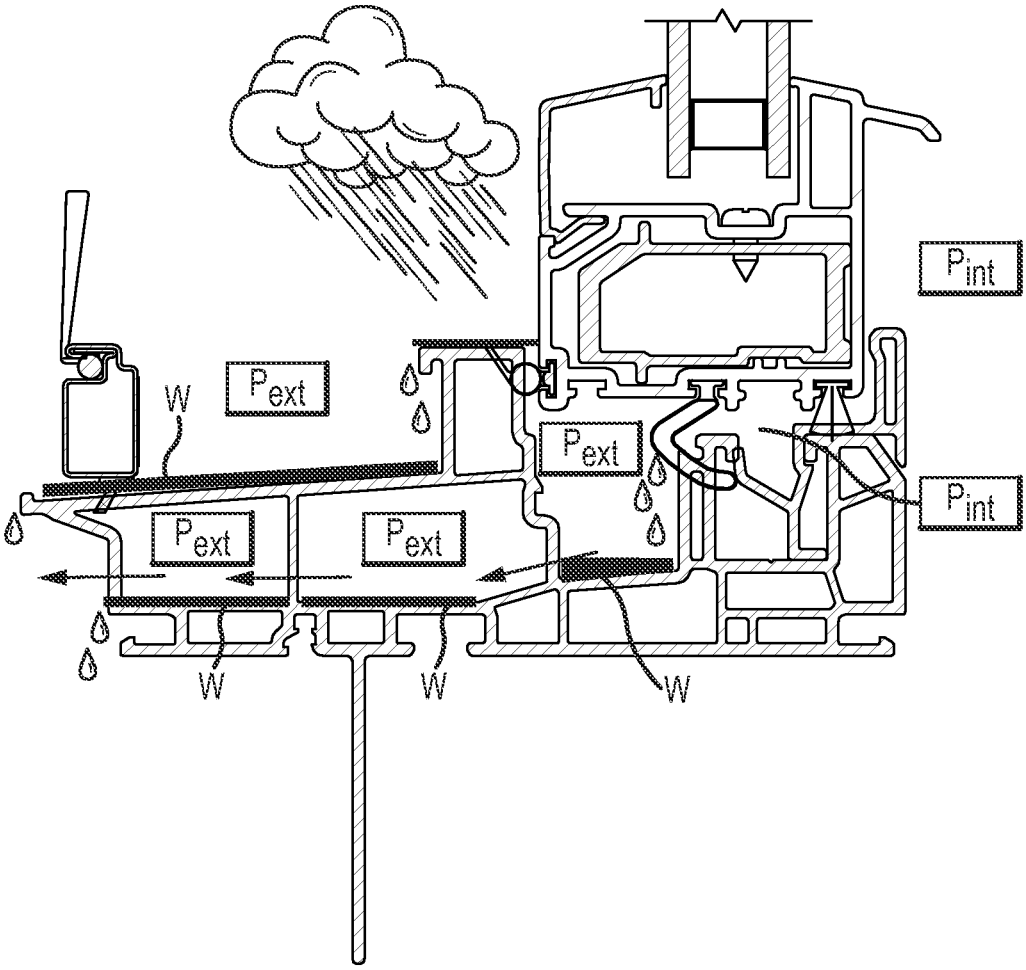
FIG. 4B is the same view as FIG. 4A with schematic water paths and operating pressures indicated.
Figure 8:
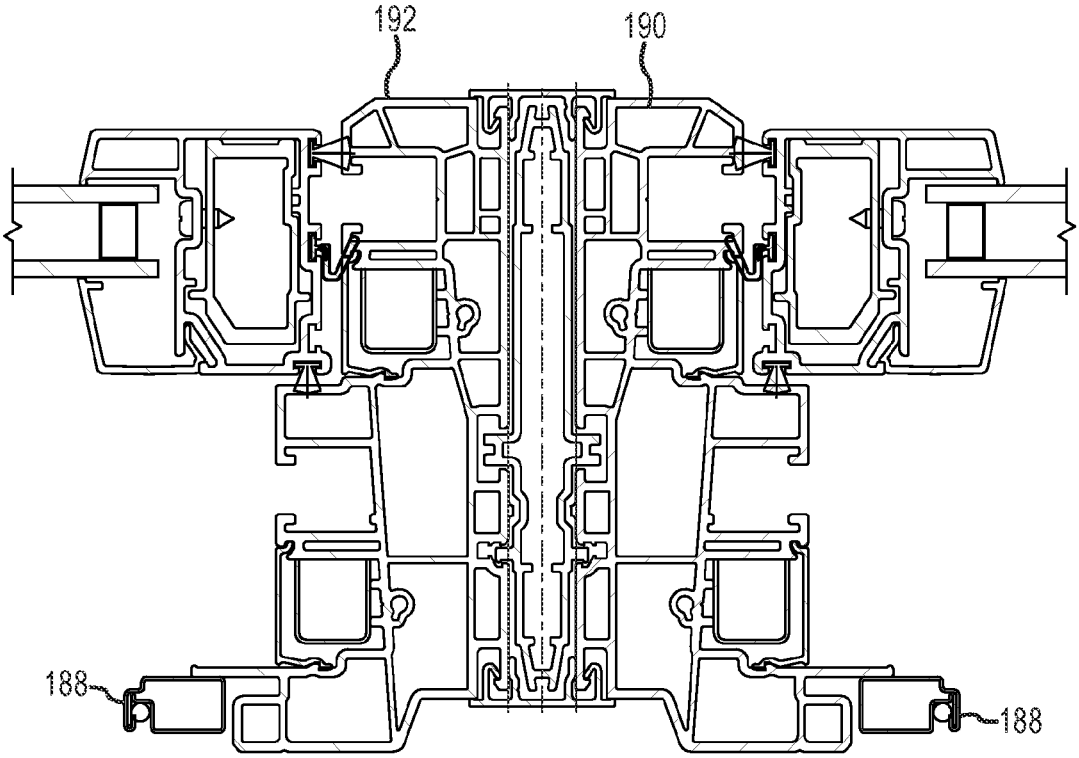
FIG. 8 is a cut away view of the window of FIGS. 2 and 3 cut along the line D-D in FIGS. 2 and 3.

As shown in FIG. 8, in windows larger than a one-wide, such as windows 200 and 300 in FIGS. 2 and 3, respectively, the jambs 190, 192 located between two sashes may include seal configurations in a manner similar to that described above.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A window having an exterior facing surface and an interior facing surface, the window comprising:

a window frame;

an active sash;

a first chamber partially defined by a first water barrier formed of one or more air permeable and water resistant materials and by a second water barrier formed of one or more air and water resistant materials, the first water barrier forming part of the exterior facing surface of the window, and the first chamber being configured to maintain an air pressure that substantially corresponds to an air pressure external to a building when the window is coupled to the building; and a second chamber partially defined by the second water barrier, the second chamber being configured to maintain an air pressure that substantially corresponds to an air pressure internal to the building when the window is coupled to the building, wherein the first chamber is configured to channel moisture entering the first chamber out of the first chamber and towards a third chamber that is configured to maintain an air pressure that substantially corresponds to the air pressure external to the building when the window is coupled to the building, the third chamber being configured to channel the moisture away from the first chamber.

2. A window having an exterior facing surface and an interior facing surface, the window comprising:

a window frame;

an active sash;

a first chamber partially defined by a first water barrier formed of one or more air permeable and water resistant materials and by a second water barrier formed of one or more air and water resistant materials, the first water barrier forming part of the exterior facing surface of the window, and the first chamber being configured to maintain an air pressure that substantially corresponds to an air pressure external to a building when the window is coupled to the building; and a second chamber partially defined by the second water barrier, the second chamber being configured to maintain an air pressure that substantially corresponds to an air pressure internal to the building when the window is coupled to the building, wherein the first chamber is further defined by a first chamber side, a bottom chamber side, and a second chamber side, wherein the second water barrier contacts a bottom surface of the active sash and the second chamber side, and wherein the first water barrier contacts the first chamber side at a contact point that is further from the bottom chamber side than a contact point at which the second water barrier contacts the second chamber side.

3. The window of claim 2, wherein the first water barrier is a rain screen.

4. The window of claim 2, wherein the active sash is configured to move between an open position and a closed position and wherein the second water barrier is configured to contact the bottom surface of the active sash and the second chamber side when the active sash is in the closed position.

5. The window of claim 2, wherein the first water barrier is configured to contact the first chamber side at a contact point that is closer to the active sash than a contact point between the second water barrier and the second chamber side.

6. A window having an exterior facing surface and an interior facing surface, the window comprising:

a window frame;

an active sash;

a first chamber partially defined by a first water barrier formed of one or more air permeable and water resistant materials and by a second water barrier formed of one or more air and water resistant materials, the first water barrier forming part of the exterior facing surface of the window, and the first chamber being configured to maintain an air pressure that substantially corresponds to an air pressure external to a building when the window is coupled to the building;

a second chamber partially defined by the second water barrier, the second chamber being configured to maintain an air pressure that substantially corresponds to an air pressure internal to the building when the window is coupled to the building; and a third chamber located in a jamb of the window, the third chamber being in fluid communication with the first chamber and partially defined by a third water barrier that is permeable to air and a fourth water barrier that is substantially impermeable to both water and air, wherein the third water barrier is located proximate to the exterior surface of the window frame, and wherein the third chamber is configured to maintain an air pressure that substantially corresponds to the air pressure external to the building when the window is coupled to the building.

7. The window of claim 6, wherein the second water barrier and the fourth water barrier are unitarily formed of a single material.

8. The window of claim 6, further comprising a fourth chamber located in the jamb of the window, the fourth chamber being partially defined by the fourth water barrier and configured to maintain an air pressure that substantially corresponds to the air pressure internal to the building when the window is coupled to the building.

9. The window of claim 8, further comprising a fifth chamber located in a second jamb of the window, the fifth chamber being in fluid communication with the first chamber and partially defined by a fifth water barrier that is permeable to air and a sixth water barrier that is substantially impermeable to both water and air, wherein the fifth water barrier is located proximate to the exterior surface of the window frame, and wherein the fifth chamber is configured to maintain an air pressure that substantially corresponds to the air pressure external to the building when the window is coupled to the building.

10. The window of claim 9, further comprising a sixth chamber located in the second jamb of the window, the sixth chamber being partially defined by the sixth water barrier and configured to maintain an air pressure that substantially corresponds to the air pressure internal to the building when the window is coupled to the building.

11. The window of claim 10, wherein the second, fourth, and sixth water barriers are unitarily formed.

12. A window having an exterior facing surface and an interior facing surface, the window comprising:

a window frame including a first jamb and a second jamb;

an active sash;

a first chamber partially defined by a first water barrier formed of one or more air permeable and water resistant materials and by a second water barrier formed of one or more air and water resistant materials, the first water barrier forming part of the exterior facing surface of the window, and the first chamber being configured to maintain an air pressure that substantially corresponds to an air pressure external to a building when the window is coupled to the building; and a second chamber partially defined by the second water barrier, the second chamber being configured to maintain an air pressure that substantially corresponds to an air pressure internal to the building when the window is coupled to the building, wherein the window frame includes a first jamb, a second jamb, a header, and a sill, wherein the first water barrier is configured to contact the first jamb and the active sash, and wherein the second water barrier is configured to contact the first jamb and the active sash, such that the first chamber exhibits a pressure substantially corresponding to an exterior of a structure in which the window is installed even when an interior of the structure and the exterior of the structure exhibit a pressure differential.

13. The window of claim 12, wherein the first chamber is configured to channel moisture away from the first water barrier.

14. The window of claim 12, wherein the active sash is moveable with respect to the window frame between an open position and a closed position, wherein the first water barrier is configured to contact the first jamb and the active sash when the active sash is in the closed position, and wherein the second water barrier is configured to contact the first jamb and the active sash when the active sash is in the closed position.

15. The window of claim 12, wherein the second chamber is configured to exhibit a pressure substantially corresponding to the interior of the structure in which the window is installed even when the interior of the structure and the exterior of the structure exhibit a pressure differential.

16. The window of claim 15, wherein the second water barrier separates the first chamber from the second chamber.

17. The window of claim 12, wherein the active sash is a first active sash, the window further comprising:

a third jamb at least partially defining a third chamber;

a second sash;

a third water barrier configured to contact the third jamb and the second sash to form a substantially water-proof and substantially air-tight seal; and a fourth water barrier configured to contact the third jamb and the second sash to form an air-permeable water barrier, the third water barrier and the fourth water barrier being configured about the third chamber such that the third chamber exhibits a pressure substantially corresponding to the exterior of the structure in which the window is installed even when the interior of the structure and the exterior of the structure exhibit a pressure differential.

18. The window of claim 17, wherein the second sash in a second active sash.

* * * * *